United States Patent [19]

Kim et al.

[11] Patent Number: 4,919,276

[45] Date of Patent: Apr. 24, 1990

[54] PORTABLE DESK TOP TRAY

[76] Inventors: Yun S. Kim; Mee S. Kim, both of 5702 Oak Stake Ct., Burke, Va. 22015

[21] Appl. No.: 311,852

[22] Filed: Feb. 17, 1989

[51] Int. Cl.[5] ..... A47F 7/00

[52] U.S. Cl. ..... 211/13; 211/50; 211/69.1

[58] Field of Search ..... 211/10, 11, 13, 69.1, 211/70.1, 71, 72, 126; 206/224, 225, 215, 411; D19/78, 75, 77, 89, 67

[56] References Cited

U.S. PATENT DOCUMENTS

| | | | |
|---|---|---|---|
| D. 138,852 | 9/1944 | King | D19/89 |
| D. 254,317 | 2/1980 | Chicone | D19/77 X |
| D. 288,827 | 3/1987 | Wolff | D19/78 |
| D. 290,852 | 7/1987 | Wang | D19/75 |
| D. 293,254 | 12/1987 | Appel et al. | D 21/59 |
| 1,194,618 | 8/1916 | Gottschalk | 206/225 X |
| 2,107,194 | 2/1938 | Yacker et al. . | |
| 2,720,189 | 10/1955 | Newman | 211/60.1 X |
| 4,111,299 | 9/1978 | Taub | 206/215 |
| 4,176,743 | 12/1979 | Fitzpatrick | 206/214 |
| 4,696,399 | 9/1987 | Windorski | 206/565 |

*Primary Examiner*—Robert W. Gibson, Jr.

*Attorney, Agent, or Firm*—Birch, Stewart, Kolasch & Birch

[57] ABSTRACT

A portable desk top tray having a stamp dispenser which comprises a main frame, a rectangular memo sheet depression disposed in the main frame, an outward bent wall attached parallel to the rear wall of the memo sheet depression for forming an envelope and letter container, and a hollow body with multiple functions attached to one side wall of the memo sheet depression for including a stamp dispenser, a tape dispenser, pen holders, and an elongated channel for receiving an envelope opener, whereby the desk top tray is organized and arranged with a plurality of desk implements very well so that the desk top tray is simple in construction, compact for portability, inexpensive to manufacture, durable in use, and refined in appearance.

4 Claims, 1 Drawing Sheet

PORTABLE DESK TOP TRAY

BACKGROUND OF THE INVENTION

1. Field of the Invention

The present invention relates to a portable desk top tray for storing office supplies customarily kept at an office worker's desk and more particularly, to a desk top organizer which comprises a memo sheet depression, an envelope container, an envelope opener, a tape dispenser, wirting device holders, and a stamp dispenser therein for organizing and arranging customary desk utensils in an attractive and conveniently accessible manner.

2. Field of the Prior Art

Practically every office worker is provided with numerous desk implements with which to carry out one's duties. These generally include memo pads, envelopes, a letter opener, a tape dispenser, pen, pencils, and stamps, etc. Accordingly, the necessity of a unitary storage facility for office supplies requires that there are several types of desk top organizers which are known in the art. However, such desk top organizers have proven to be unpractical for various purposes. Such desk top organizers are shown in U.S. Pat. No. 2,107,194 to Yacker et al, U.S. Pat. No. 4,111,299 to Taub, U.S. Pat. No. 4,176,743 to Fitzpatrick, U.S. Pat. No. 4,696,399 to Windorski, U.S. Pat. No. Des. 290,852 to Wang, and U.S. Pat. No. Des. 293,254 to Appel et al.

SUMMARY OF THE INVENTION

Accordingly, it is an object of the present invention to provide an improved portable desk top tray having a stamp dispenser.

Another object of the present invention is to provide a desk top organizer containing a memo sheet depression for storing memo pads, an envelope container for receiving envelopes and letters, and a body with multiple functions provided with a tape dispenser, a stamp dispenser, pen holders, and a horizontal elongated channel for containing an envelope opener therein so that the desk top organizer may be attractive and compact for organizing and arranging a plurality of desk implements in a readily accessible manner.

A further object of the present invention is to provide a mail stationery assembly in combination with a letter and envelope container, a stamp dispenser, and letter opener in an organized fashion therein.

Yet another object of the present invention is to provide a tray for desk implements which is simple in construction, relatively economical to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a portable desk top tray having a stamp dispenser which comprises a main frame, a rectangular memo sheet depression disposed in the main frame, an outward bent wall attached parallel to the rear wall of the memo sheet depression for forming an envelope and letter container, and a hollow body with multiple functions attached to one side wall of the memo sheet depression for including a stamp dispenser, a tape dispenser, pen holders, and an elongated channel for receiving an envelope opener, whereby the desk top tray is well organized and arranged with a plurality of desk implements so that the desk top tray is simple in construction, compact for portability, inexpensive to manufacture, durable in use, and refined in appearance.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
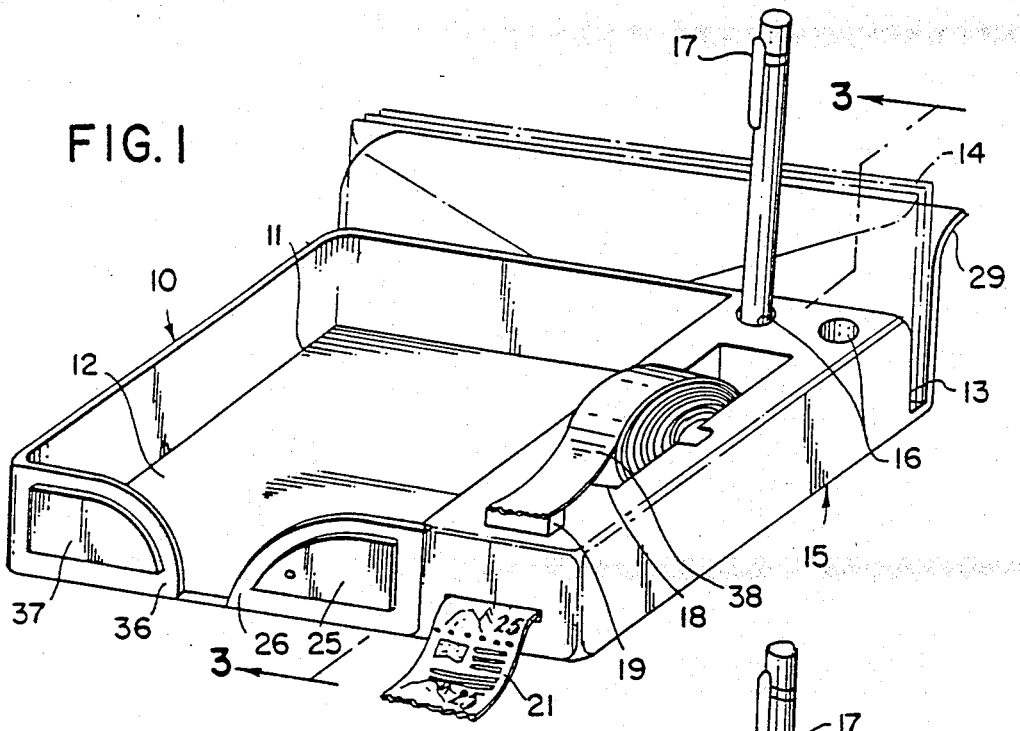
FIG. 1 is a perspective view of a desk top tray according to the present invention.
Figure 3:
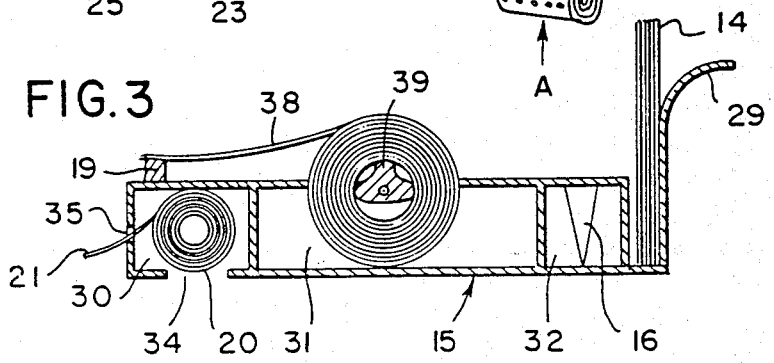
FIG. 3 is a sectional view of FIG. 1, taken along line 3—3.

Referring now in detail to the drawings for the purpose of illustrating preferred embodiments of the present invention, the desk top tray as shown in FIGS. 1 and 3 comprises a rectangular main frame 10, a memo sheet depression 11 disposed in the main frame 10 for receiving memo pads 12, a envelope container 13 for containing a plurality of letter or envelopes, and a hollow body 15 having multiple functions attached to one side wall of the main frame 10 for including conical pen holders 16, a tape dispenser, a stamp dispenser, and a letter opener 23.

The rectangular main frame 10 is provided with four side walls for forming the memo sheet depression 11 which has a rectangular configuration so as to receive rectangular memo pads 12.

The envelope container 13 is formed by extending from the rear wall of the rectangular main frame 10 to an outward bent wall 29 for containing a plurality of various types of envelopes and letters 14. The bent wall 29 is higher than the rear wall of the main frame 10 for supporting letters and envelopes 14 kept in the envelope container 13.

Figure 2:
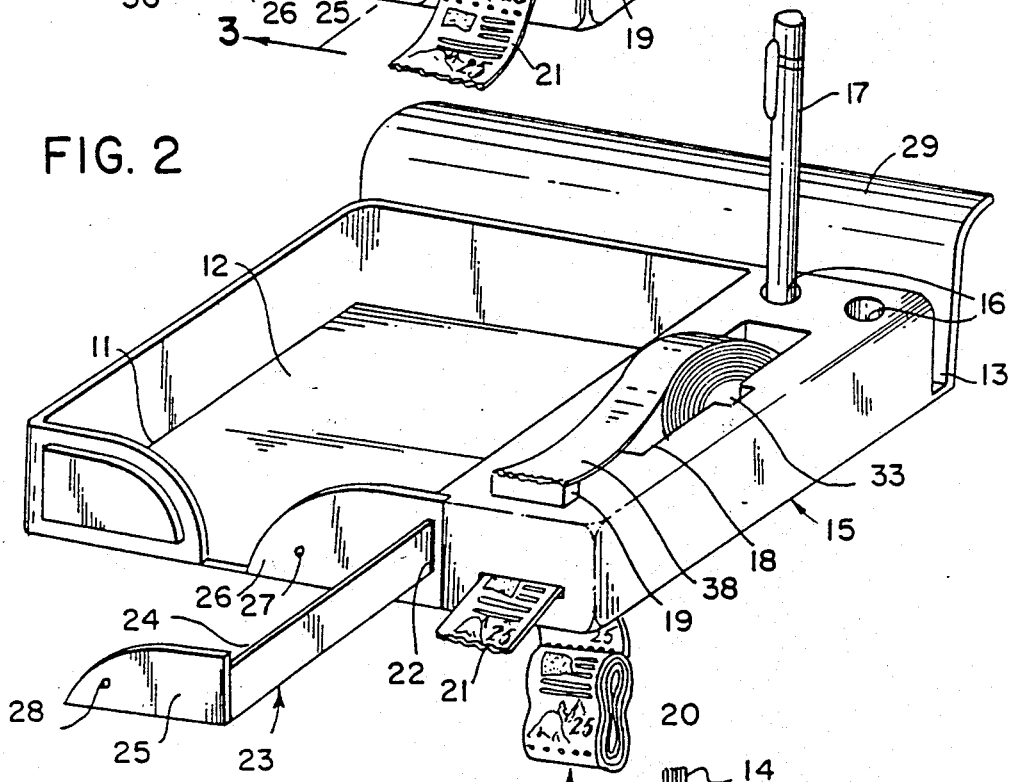
FIG. 2 is a perspective view of the desk top tray according to the present invention showing a letter opener in its open position and a roll of stamps to be inserted into the desk top tray.

As shown in FIG. 3, the hollow body 15 has three compartments including a first, a second, a third boxes 30, 31, and 32. The first box 30 is provided with a tape cutter supported thereon for cutting tape 38, a stamp inlet 34 for inserting a roll of stamps 20 into the first box 30, and a stamp outlet 35 for dispensing a stamp 21, one by one. Also, the roll of stamps 20 can be squeezed by hand and inserted into the first box through the stamp inlet 34 in the direction indicated by arrow (A) as shown in FIG. 2. The second box 31 is provided with a roll of tapes 18 by engaging a tape shaft 39 in engagements 33 (FIG. 2). The tape 38 can be cut by the tape cutter 19 supported on the first box 30. The third box 32 is provided with a plurality of writing device holders 16 for holding a plurality of writing devices such as pens, ball point pens, fountain pens, pencils, or the like.

The letter opener 23 having an "L" shaped configuration is slidably engaged in an horizontal elongated channel 22 through a blade portion 24. A handle 25 of the letter opener 23 contains an aperture 28 for receiving a pin 27 supported on one of the front walls 26 in the vicinity of the body 15 (FIG. 2). The outside of the handle 25 may be designed to be the same as to the other front wall for providing a refined appearance. The letter opener 23 may be put in the elongated channel 22 when it is not in use.

The desk top tray of the present invention is preferably formed of a light weight plastic material but may otherwise be constructed of any material which may be molded, stamped, or assembled into the configuration as defined above. In certain embodiments, the bent wall 29 may be secured to the rear side wall of the main frame as an outward bent sheet material.

The light weight and attractive desk organizer tray of the present invention is capable of arranging and supporting substantially all of the desk implements commonly used by an office worker. The tray may be prepacked in advance with a full set of desk implements so as to be available for distribution as a unit. Such a practice would substantially simplify the purchase, inventory, and distribution of office supplies by an office manager, purchasing agent, or the like.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A portable desk top tray for organizing and arranging a plurality of desk implements which comprises:

a main frame, a memo sheet depression formed in said main frame for receiving memo pads, an envelope container for containing a plurality of letters and envelopes, said envelope container being formed by extending an outward bent wall from the rear side wall of said main frame, a hollow body extended from the one side wall of said main frame, said hollow body defining a first box, a second box, and a third box, said first box including a bottom opening and a front opening for inserting a roll of stamps into and dispensing stamps therefrom, one by one, said second box including a roll of tape disposed therein for dispensing a tape from the roll of tape through a tape cutter supported on the top of said first box, said third box including a plurality of writing device holders with a conical configuration, respectively, for receiving various types of writing devices, and an "L" shaped envelope opener slidably engaged in an elongated channel disposed in said hollow body, said envelope opener having a blade portion and a handle with an aperture for being adapted to engage in a pin disposed on one outside wall of said main frame, whereby the desk top tray is compact and attractive and is arranged in a readily accessible manner.

2. The portable desk top tray of claim 1, wherein the main frame has a rectangular configuration and is made of light weight plastic.

3. The portable desk top tray of claim 1, wherein the memo sheet depression has a rectangular configuration for mating with the rectangular main frame.

4. The portable desk top tray of claim 1, wherein the writing devices are pens, ball point pens, fountain pens, or pencils.

* * * * *